United States Patent [19]

Wafer et al.

[11] Patent Number: 4,625,190

[45] Date of Patent: Nov. 25, 1986

[54] REMOTELY CONTROLLED SOLENOID OPERATED CIRCUIT BREAKER

[75] Inventors: John A. Wafer, Brighton Township, Beaver County; Walter V. Bratkowski, McKeesport, both of Pa.

[73] Assignee: Westinghouse Electric Corp., Pittsburgh, Pa.

[21] Appl. No.: 707,632

[22] Filed: Mar. 4, 1985

[51] Int. Cl.[4] ..... H01H 83/00

[52] U.S. Cl. ..... 335/20

[58] Field of Search ..... 335/14, 20, 167, 168, 335/169, 201, 172, 173

[56] References Cited

U.S. PATENT DOCUMENTS

| | | | |
|---|---|---|---|
| 3,602,674 | 8/1971 | Koennecke | 335/173 X |
| 3,786,380 | 1/1974 | Harper | 335/201 X |
| 4,001,743 | 1/1977 | Arnhold | 335/201 |
| 4,223,288 | 9/1980 | Stiner | 335/20 |

FOREIGN PATENT DOCUMENTS 2176494 11/1973 France .

*Primary Examiner*—L. T. Hix
*Assistant Examiner*—Brian W. Brown
*Attorney, Agent, or Firm*—L. P. Johns

[57] ABSTRACT

A manually and remotely operated circuit breaker for use in energy management characterized by a manually operable overcenter toggle linkage mechanism for opening and closing a circuit, electromagnetic actuating current limiting means for opening the circuit in response to a short circuit, a bimetal in response to overload currents, and electromagnetic pulse actuated means for opening and closing the circuit in response to a control signal from a remote location when the manually operable means is open.

8 Claims, 7 Drawing Figures

REMOTELY CONTROLLED SOLENOID OPERATED CIRCUIT BREAKER

CROSS REFERENCE TO RELATED APPLICATION

This application is related to the copending application Ser. No. 707,616, filed Mar. 4, 1985, entitled "Current Limiting Solenoid Operated Circuit Breaker", of Y. K. Chien, W. V. Bratkowski and J. A. Wafer assigned to the present assignee.

BACKGROUND OF THE INVENTION

1. Field of the Invention

This invention relates to circuit breakers and, more particularly, it pertains to circuit breakers having a remotely controlled electromagnetic solenoid and functions both as a current limiting circuit breaker and contactor with a single set of contacts that is operated manually, by a bimetal, by a short circuit trip coil, or by a solenoid-bistable device.

2. Description of the Prior Art

In recent years, electrical distribution systems have increased in size and capacity to meet expanding demands of electrical service. Utilities have adopted lower impedance transformers to reduce system power losses, regulation problems, and cost. But the short circuit fault currents available to plaque distribution systems continue to increase, reaching as high as 200,000 A.

To prevent these high available fault currents from damaging electrical distribution systems, protective devices limiting the perspective let-through currents are required. Fuses and, more recently, current limiting circuit breakers, have been used successfully to limit these fault currents. They can reduce, to tolerable levels, both the peak fault currents ($I_p$) and thermal energy ($I^2t$) that reach downstream equipment. Mechanical and magnetic forces that can destroy equipment are proportional to the square of the peak currents $(I_p)^2$, and thermal damage is proportional to the energy let-through ($I^2t$).

Large short circuit currents result from the use of low impedance transformers and interconnected networks in modern low voltage AC power distribution systems. Fault currents in excess of 100 KA are common. Traditionally, high fault current prediction has been provided in current limiting fuses in conjunction with circuit breakers. However, a new generation of high speed electromagnetically driven, single, and multiple break current limiting devices have been developed. These devices not only perform the function of a circuit breaker and current limiting fuse, but are also resettable and reusable. These devices can also be effectively applied to motor control as well as power distribution systems.

Associated with the forgoing is a growing need for electronic means for communication and control in electrical distribution systems. For that purpose, circuit breakers operated by remotely controlled electromagnet means, such as by a solenoid, have been employed. One disadvantage of some types of these circuit breakers has been a requirement of continued power to keep the contacts closed. Here the tripping time could be delayed because of the time required to collapse the flux in the solenoid and open the contacts.

Another disadvantage of some prior circuit breakers has involved the safety of personnel. Some prior circuit breakers could be actuated by remote control to an "on" or closed circuit condition, even through the breaker had been previously tripped to an open circuit by a person on-site for some purpose such as maintenance.

SUMMARY OF THE INVENTION

In accordance with this invention a circuit breaker for use in energy management systems is provided that comprises an insulating housing having terminals thereon; separable contact means including a stationary contact member and a movable contact member disposed in the housing to form a circuit breaker path between the terminals; manual actuating means within the housing for operating the circuit breaker and including an operating lever and a releasing lever for opening and closing the separable contact means; the actuating means also including an assist lever opeable on the movable contact member and cooperable with the operating lever to close the contacts; first electromagnetic means including lever means for actuating the movable contact member and energized by a remote circuit; coupling means between the first electromagnetic means and the movable contact member and including a bistable overcenter toggle mechanism for moving the movable contact member only when the manual actuating means is in the closed-contact position and without actuating the manual actuating means from the closed-contact position; the bistable overcenter toggle mechanism including a pivotally mounted body and a first spring biased pawl on the body for movement between open and closed positions of the movable contact member in response to movement of the lever means so as to move said body between corresponding positions; second electromagnetic means responsive to an overcurrent condition in the path of the circuit passing through the contacts for actuating the contacts to the open position; and the assist lever comprising a second pawl on the side of the movable contact member and cooperable with the operating lever to move said member to the closed circuit position.

The circuit breaker of this invention provides a bistable toggle mechanism with a solenoid that is actuated by a pulse by remote control of an energy management system. The circuit breaker is stable in either open or closed conditions, but is not capable of actuation from open to closed status when the manually controlled switch is open.

DESCRIPTION OF THE PREFERRED EMBODIMENTS

Figure 1:
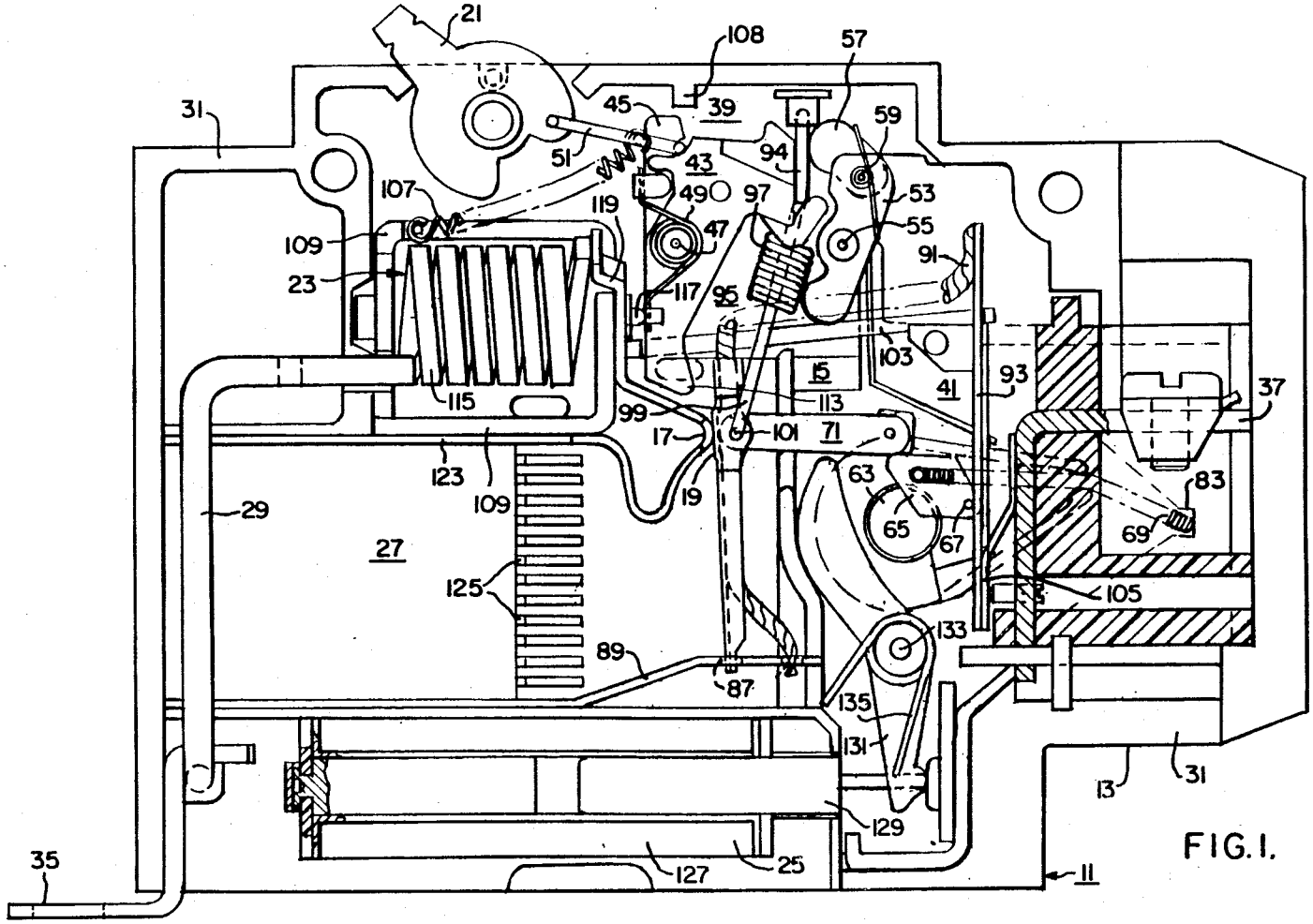
FIG. 1 is a vertical sectional view through a circuit breaker, taken on the line I—I of FIG. 2, showing contacts in a closed position.

In FIG. 1, a circuit breaker is generally indicated at 11 and it comprises a housing 13 and circuit breaker structure 15 including stationary contact 17 and movable contact or contact member 19, means for actuating the movable contact including a handle 21, a current limiting electromagnetic mechanism 23, a solenoid structure 25, and a bimetal strip 93. The circuit breaker 11 also comprises an arc quenching device 27 and a conductor 29.

Figure 2:
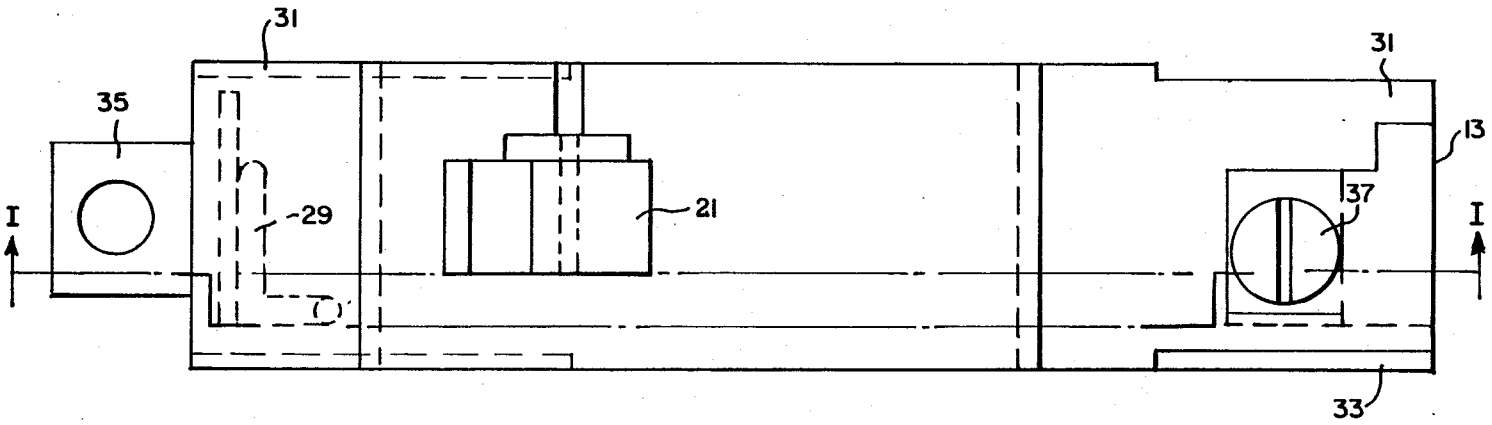
FIG. 2 is a plan view of the circuit breaker of FIG. 1.

The housing 13 is comprised of a body 31 and a detachable cover 33 (FIG. 2), both of which are comprised of an electrically insulating material, such as an epoxy resin or thermoplastic material. A line terminal 35 is mounted on extends from the housing body 13 (as shown at the left of FIG. 1). A load terminal 37 extends from the right end thereof.

The circuit breaker structure 15 is mounted within the chamber of the housing 13 and comprises an unlatching mechanism 39 and a bistable toggle mechanism 41. The unlatching mechanism 39 includes an operating or kicking lever 43 and a releasing lever 45, both of which are pivotally mounted on a pivot pin 47. The releasing lever 45 fits within a recess of the operating lever 43 where it is retained in place by a bias spring 49 (FIG. 1). A wire bail 51 extends from the handle 21 to the upper end of the releasing lever 45.

The circuit breaker structure 15 also comprises an assist lever 53 pivoted at 55, which lever includes a pawl 57 which is pivoted at 59 on the upper end of the lever 53. The assist lever 53 cooperates with the unlatching mechanism 39 for preventing closing of the contacts 17, 19, when the handle 21 is in the "off" or tripped position (FIG. 3) which is described more fully hereinbelow.

Figure 4:
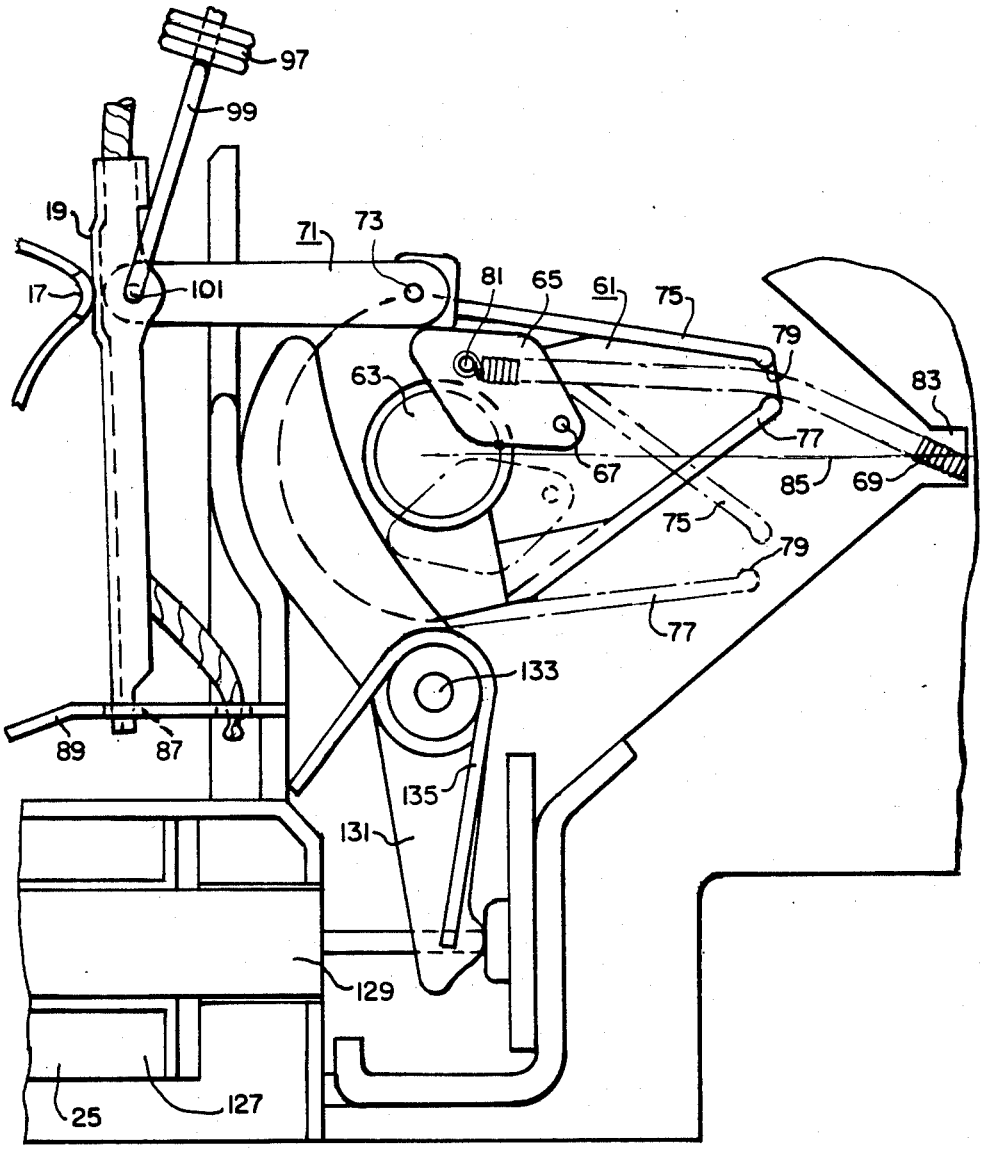
FIG. 4 is an enlarged fragmentary view of the bistable toggle mechanism in the contact-closed position.
Figure 5:
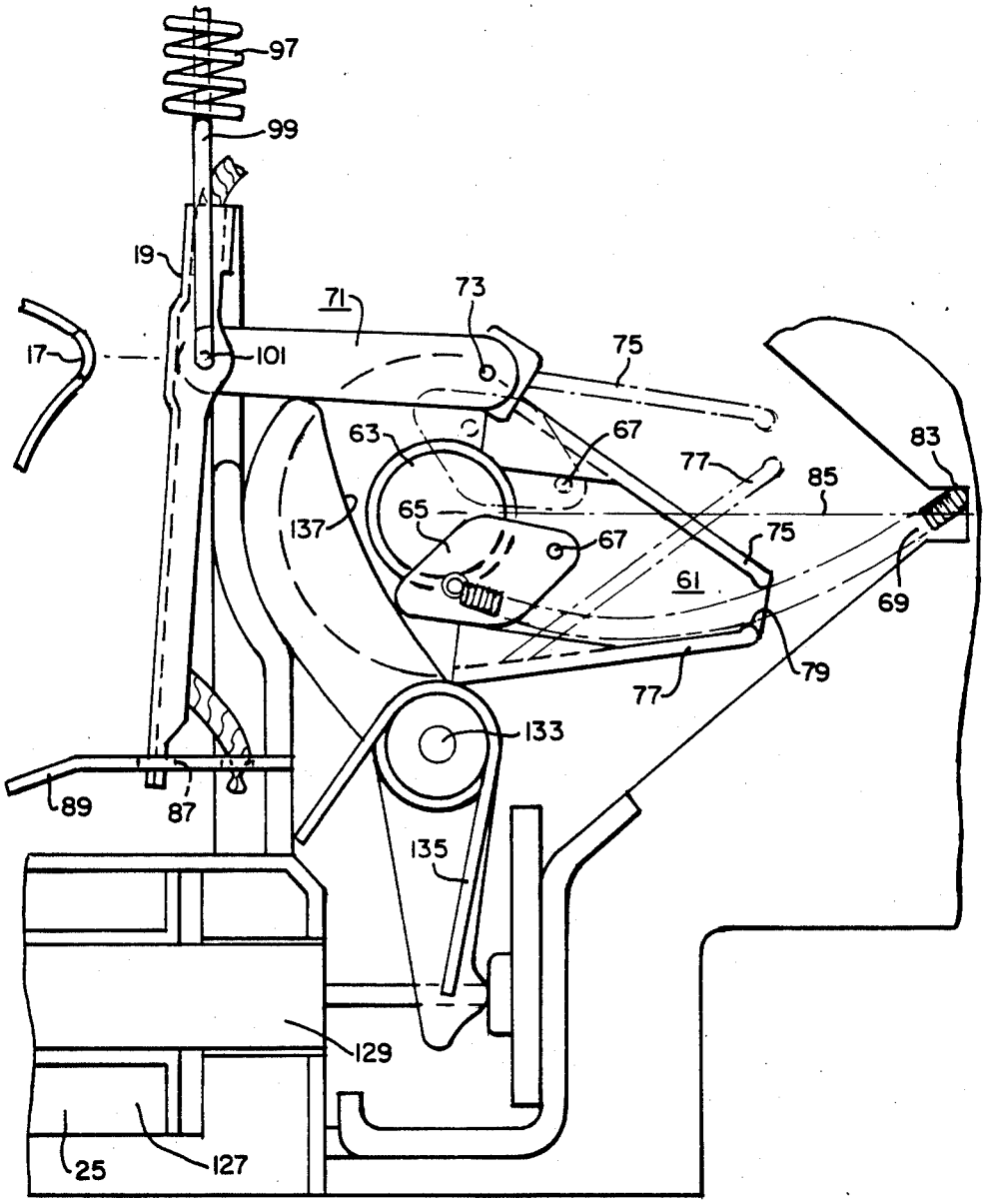
FIG. 5 is a view similar to FIG. 4 with the contacts open.

The bistable toggle mechanism 41 (FIG. 4) includes a lever 61 pivoted at pin 63, a spring-biased pawl or flipper 65 pivoted at 67 on the lever, and a toggle spring 69. A connecting link 71, pivoted at 73, extends between movable contact 19 and the lever 61. The lever 61, being a pear-shaped body, includes flanges 75, 77 which extend upwardly from the surface of the lever and form opening means or notch 79. The toggle spring 69 is secured at one end to a pin 81 on the flipper 65 and extends therefrom through the notch 79 to a location 83 on the housing body 31 below the load terminal 37 (FIG. 1). When the contact 19 is disposed in the contact-closed position, the lever 61 is disposed with the notch 79 located above an imaginary line 85 extending between the pin 63 and the location 83, whereby the spring 69 extends as shown and causes the flipper 65 to be located in a position (FIG. 4) adjacent the flange 75. On the other hand, when the contacts are open, the lever 61 is in the position (FIG. 5) with the notch 79 disposed below the line 85, whereby the spring 69 pulls the flipper 65 to the position adjacent the flange 77 (FIG. 5).

The movable contact 19 is an elongated member pivoted in a hole 87 in an arc guide rail 89. The upper end of the contact 19 is connected to a shunt 91 (FIG. 1) which is connected to the upper end of a bimetal strip 93. The movable contact 19 is influenced by a spring assembly 95 which includes a coil spring 97 and a spring guide bail 99 (FIG. 1). The lower end of the bail 99 is pivotally connected at 101 where the link 71 is similarly pivoted. The upper end of the guide bail 99 is disposed between the kicking lever 43 and the pawl 57 of the assist lever 53. In operation, the spring assembly 95 functions as a toggle spring mechanism for moving the contact 19 between the closed position (FIG. 1) and the open position (FIG. 3), whereby the pivot 101 moves from one side of a line extending from the hole 87 to the upper end of the spring 97.

The contacts 17, 19 are open and closed by three conventional means including the manually operated handle 21, the bimetal strip 93, and the current limiting electromagnetic device 23. The bimetal strip 93 is operable through a link 103 which extends from the strip to the release lever 45, whereby an overcurrent passing through the bimetal strip causes it to move clockwise about its lwoer end where it is connected to a conductor 105, thereby moving the link 103 to the right to actuate the release lever 45.

Figure 3:
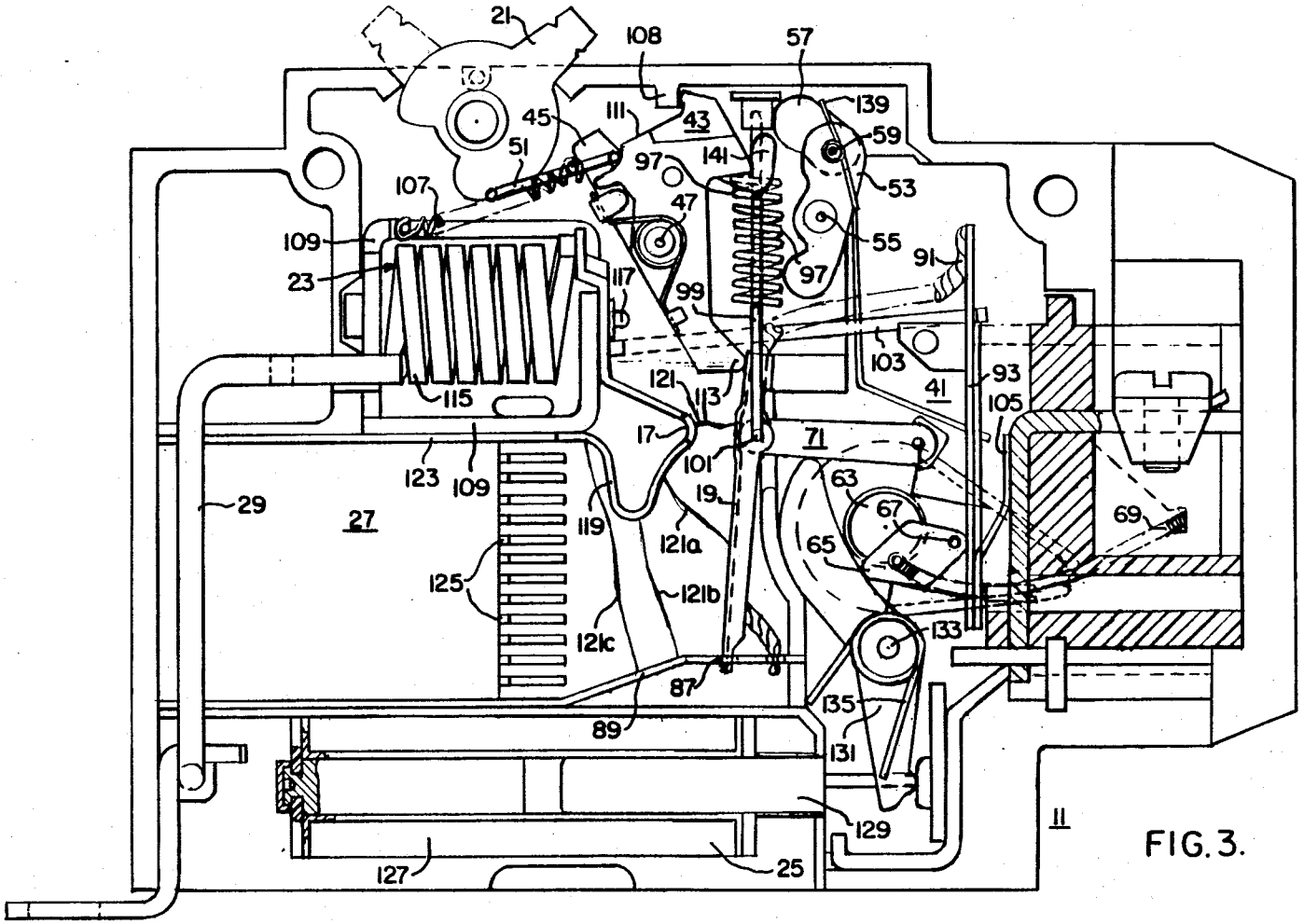
FIG. 3 is a vertical sectional view showing the contacts in the open position.

Rotation of the release lever 45 rotates the kicking lever 43 counterclockwise, whereby the lower end portion 113 of the lever 43 kicks the movable contact 19 away from the stationary contact 17 (FIG. 3). Simultaneously, the release lever 45 rotates to a retracted position (FIG. 3) to unlatch the bail 51 from a latched position (FIG. 1) between the levers 43 and 45. As the movable contact 19 moves, the spring assembly 95 moves overcenter to release the coil spring 95 that, in turn, rotates the kicking lever 43 counterclockwise to retain the movable contact in open position (FIG. 3). At the same time the unlatched bail 51 rides over a top surface 111 of the kicking lever 43 until the lever hits a stop 108 protruding from the housing. The spring 107 rotates the handle 21 to the "off" position after the contacts are open and resets the wire bail 51 in a notch (FIG. 3) between the levers. In this manner the lever 43 moves quickly to open the contacts without being delayed by overcoming inertia of rotating the handle 21 from "on" to "off"; however, it is understood that the overall action is so fast that it appears to be simultaneous.

The current limiting electromagnetic device 23 comprises a coil 115 and an armature 117 supported within the frame 109 which in turn is mounted on the housing body 13. If a release operation is a result of a short circuit, the armature 117 strikes the release lever 45 to actuate the kicking lever 43, thereby moving the spring assembly 95 through the toggle operation to move the movable contact 19 to the position shown in FIG. 3.

The circuit thorugh the circuit breaker 11 (FIG. 1) extends from the line terminal 35 through the conductor 29, the coil 115 and conductor 119 including the stationary contact 17, the movable contact 19, the shunt 91, the bimetal strip 93, and the conductor 105 to the load terminal 37.

During separation of the contacts 17, 19, any arc 121 (FIG. 3) that develops travels from the point of origin into the arc quenching device 27, such as indicated by arc positions 121*a*, 121*b*, and 121*c* with the arc extending to greater length between the lower portions of the conductor 119 and the lower portion of the contact member 19. From there, the lower arc guide rail 89 and upper guide rail 123, with which the conductor 119 is connected, guide the arc to arc extinguishing plates 125 where the arc is extinguished.

The combined force, a product of current density and magnetic field applied on the arc column and perpendicular thereto, drives, moves, or blows the arc out of the contact area onto the rails 89, 123, as soon as possible after the contacts separate. The circuit breaker 11 is provided with means for interrupting the current in addition to the manual handle 21, the current limiting electromagnetic device 23, and the bimetal strip 93. The additional means includes the solenoid structure 25 and associated parts thereof including the bistable mechanism 41 to enable energy management and remote control operation.

Figure 6:
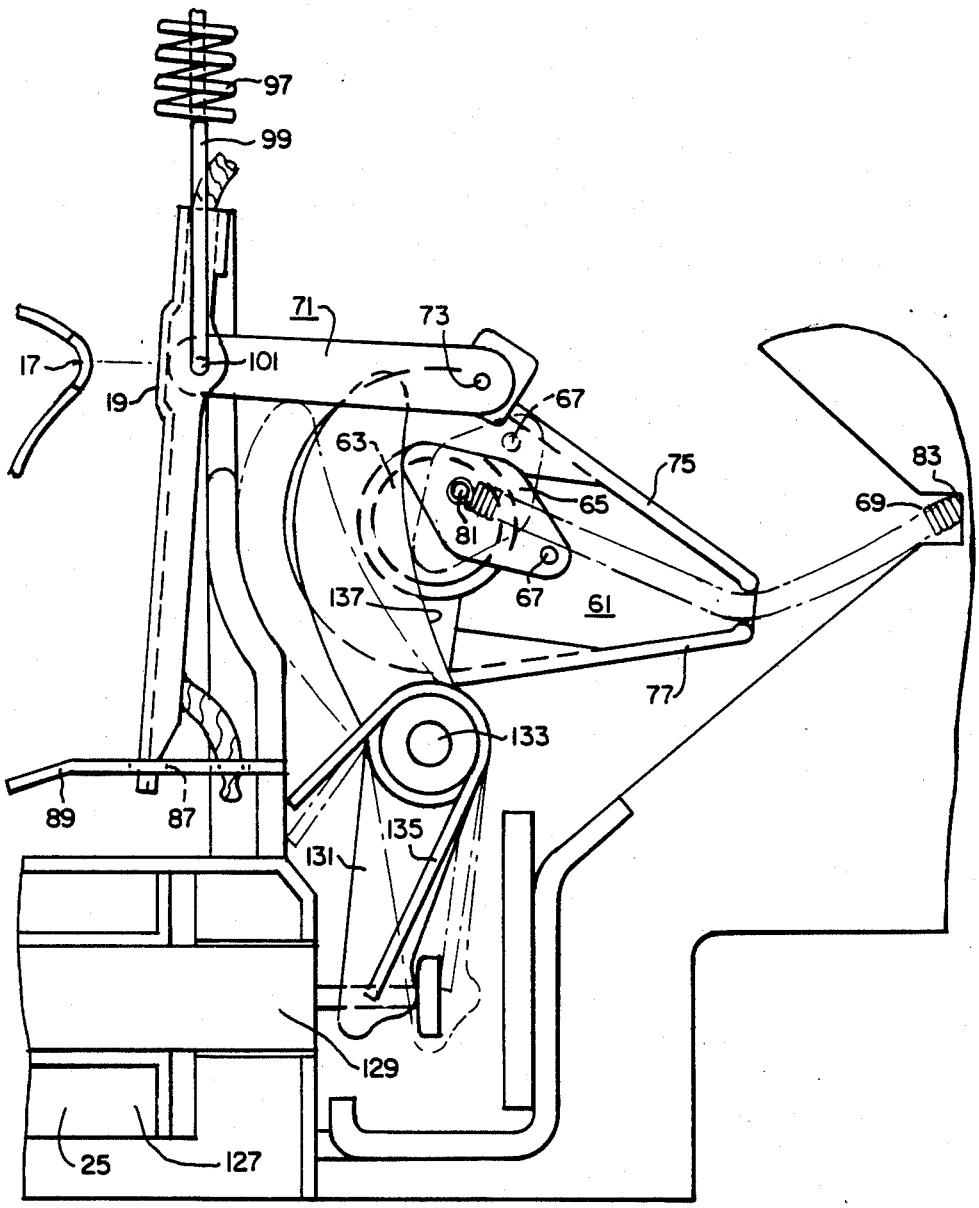
FIG. 6 is a fragmental view of the bistable toggle mechanism with the actuation lever in the actuated position and the mechanism in the contact-open position.

The solenoid structure 25, which is electrically controlled from a remote location, comprises a coil 127 and plunger 129. The plunger extends through an opening in the lower portion of a lever or propeller 131. When the solenoid structure 25 is actuated by a pulse of current, the plunger 129 retracts into the coil, moving the propeller 131 about a pivot 133 from the broken line position (FIG. 6) to the solid line position 131. As the propeller moves to the later position, it strikes the flipper 65 and rotates the lever 61 clockwise around the pivot 63 to the broken line position 77 (FIG. 4). By that movement of the lever 61, the link 71 pulls the movable contact 19 away from the stationary contact 17, thereby opening the circuit. Thereafter, the plunger returns to the extended position (FIG. 4) under the influence of a wire spring 135 and returns the propeller to the retracted, broken line position (FIG. 6). As the lever 61 rotates counterclockwise, the notch 79 moves below the line 85 and relocates the position of the spring 69 with respect to the flipper (FIGS. 4, 5). Accordingly, as the propeller retracts, the flipper 65 moves counterclockwise adjacent an arcuate surface 137 of the propeller to the broken line position 65 (FIG. 6) in response to the force of the spring 69.

Figure 7:
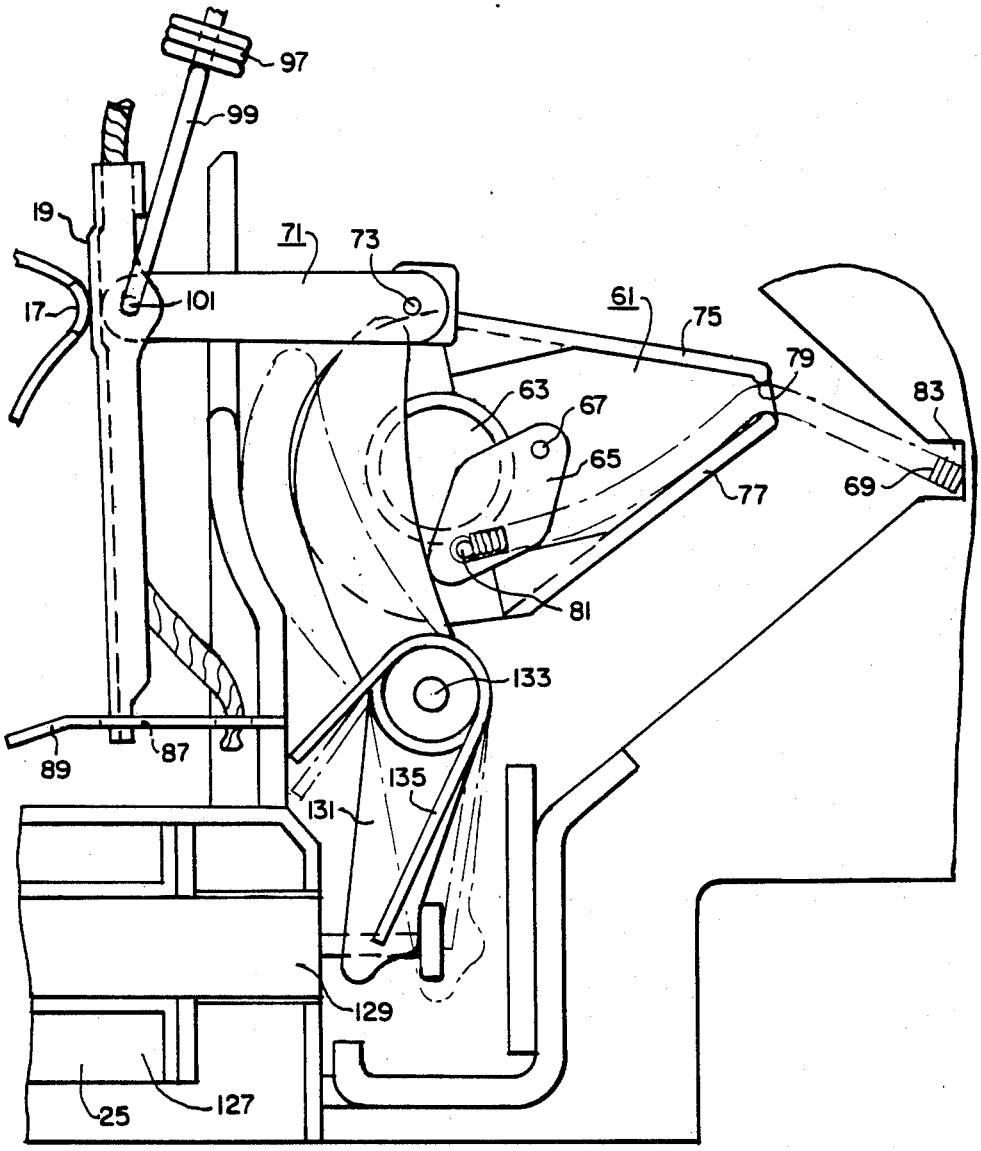
FIG. 7 is a fragmentary view of the bistable toggle mechanism with the lever in the actuated position and the mechanism in the contact-closed position.

Subsequently, when the solenoid structure 25 is actuated by a pulse of current to close the contacts, the propeller 131 moves against the lower end of the flipper 65 (FIG. 7) to rotate the lever 61 counterclockwise in response to the pressure on the pivot 67 of the flipper, thereby moving the movable contact 19 against the stationary contact 17 in response to a movement on the line 71. As the lever 61 rotates counterclockwise, the notch 79 moves above the line 85 (FIG. 5), whereupon the spring 69 rotates the flipper 65 clockwise to the upper position (FIG. 4) as the propeller retracts. Accordingly, the bistable toggle mechanism 41 is returned to its original condition with the contacts closed.

Operation of the bistable toggle mechanism for closing the contacts is dependent upon the position of the manual handle 21. When the handle is in the "on" position (FIG. 1), remote control of the circuit breaker through the solenoid structure 25 and the bistable toggle mechanism is feasible. But when the manual handle is in the "off" position (FIG. 3), the contacts are open and remote control for closing the contacts is not feasible.

More particularly, with the manual handle in the tripped or "off" position, an attempt to close the contacts by actuating the propeller 131 against the flipper 65 (FIG. 6) is defeated by pressure against the movable contact 19 by the lower end portion 113 of the operating lever 43 (FIG. 3). In that position, the pawl 57 is disposed against the upper end of the lever 43 to prevent its clockwise rotation about the pivot 47 in response to any attempt thorugh the link 71 to close the contacts. The pawl 57 is rotated to that position under the force of a wire spring 139 when the handle 21 is disposed in the "off" position.

Subsequently, when the handle 21 is moved to the "on" position, the portion 141 of the lever 43 compresses the spring 97 and slides under the surface of the pawl 57, causing it to move against the spring 139 to return to the upper position as shown in FIG. 1, whereby the lower end portion 113 of the lever is retracted from the upper portion of the movable contact 19. Thus the remote control operation of the circuit breaker 11 through the solenoid structure 25 is again feasible.

In conclusion, the circuit breaker of this invention provides a current limiting solenoid operated means for an energy management system by an electric pulse. Though the circuit breaker is stable in either open or closed conditions, it cannot be actuated to a closed circuit condition by remote control when a manual handle is in the trip or "off" position.

What is claimed is:

1. A circuit breaker for use in energy management systems, comprising:

an insulating housing having electrical terminals thereon;

separable contact means including a stationary contact member and a movable contact member disposed in the housing to form a circuit breaker path between the terminals;

manual actuating means within the housing for operating the circuit breaker and including an operating lever and a releasing lever for opening and closing the movable contact member;

the actuating means also including an assist lever operable on the movable contact member and cooperable with the operating lever to close the contacts;

first electromagnetic means for actuating the movable contact member and energized by an electric pulse for opening or closing the circuit from a remote circuit;

coupling means between the electromagnetic means and the movable contact member;

the operating lever being positioned to prevent closing of the contacts by the first electromagnetic means when the manual actuating means is in an open-contact position;

the movable contact member comprising an overcenter toggle structure;

the operating lever and the assist lever cooperating to move the toggle structure overcenter to the closed-contact position; and the operating lever and the assist lever being disposed on opposite sides of the toggle structure; and the coupling means comprises a bistable toggle mechanism operable to move the movable contact member only when the manual actuating means is in the closed-contact position and the first electromagnetic means includes lever means for actuating the bistable toggle mechanism.

2. The circuit breaker of claim 1 in which the bistable toggle mechanism operates the movable contact member between open and closed positions without actuating the manual actuating means from the closed condition.

3. The circuit breaker of claim 2 in which the movable contact member includes first and second pivotally connected arms, the first arm being part of the overcenter toggle structure and being clamped between the operating lever and the assist lever when the bistable toggle mechanism is operated to open and close the movable contact.

4. The circuit breaker of claim 3 in which the bistable toggle mechanism comprises a pivotally mounted body and a spring-biased pawl on the body, the pawl being movable between open and closed conditions corresponding to open and closed positions of the movable contact member in response to movement of the lever means so as to move the pivotally mounted body between corresponding positions.

5. The circuit breaker of claim 4 in which a link extends between the body and the movable contact member.

6. The circuit breaker of claim 5 in which there are second electromagnetic means responsive to an overcurrent condition in the path of the circuit passing through the contacts for actuating the contacts to the open position.

7. A circuit breaker for use in energy management systems, comprising:

an insulating housing having electrical terminals thereon;

separable contact means including a stationary contact member and a movable contact member disposed in the housing to form a circuit breaker path between the terminals;

manual actuating means within the housing for operating the circuit breaker and including an operating lever and a releasing lever for opening and closing the separable contact means;

the actuating means also including an assist lever operable on the movable contact member and cooperable with the operating lever to close the contacts;

first electromagnetic means including lever means for actuating the movable contact member and energized by an electric pulse for opening or closing the circuit from a remote circuit;

coupling means between the first electromagnetic means and the movable contact member and including a bistable overcenter toggle mechanism for movign the movable contact member only when the manual actuating means is in the closed-contact position and without actuating the manual actuating means from the closed-contact condition;

the bistable overcenter toggle mechanism including a pivotally mounted body and a first spring-biased pawl on the body for movement between open and closed positions of the movable contact member in response to movement of the lever means so as to move said body between corresponding positions; and second electromagnetic means responsive to an overcurrent condition in the path of the circuit passing through the contacts for actuating the contacts to the open position.

8. The circuit breaker of claim 7 in which the assist lever comprises a second pawl on the side of the movable contact member and cooperable with the operating lever to move said member to the closed-circuit position.

* * * * *